United States Patent [19]

Darby et al.

[11] Patent Number: 4,531,266

[45] Date of Patent: Jul. 30, 1985

[54] BURIAL VAULT STRUCTURE

[76] Inventors: James W. Darby, 2117 Smith; David L. Darby, 501 Brickyard Rd., both of Danville, Ill. 61832

[21] Appl. No.: 506,840

[22] Filed: Jun. 22, 1983

[51] Int. Cl.[3] ..... A61G 17/00

[52] U.S. Cl. ..... 27/35; 27/14

[58] Field of Search ..... 27/35, 11, 1, 2, 14, 27/15; 52/130, 131, 132, 133, 134, 135, 136, 137, 138, 141

[56] References Cited

U.S. PATENT DOCUMENTS

| | | | |
|---|---|---|---|
| 455,093 | 6/1891 | Breeze | 27/1 |
| 2,162,435 | 6/1939 | Hopkins | 52/136 X |
| 3,778,941 | 12/1973 | Dorris | 52/134 X |
| 4,073,100 | 2/1978 | DiGiovanni, Jr. | 52/136 X |
| 4,209,880 | 7/1980 | Lidholm | 27/2 |

*Primary Examiner*—Robert A. Hafer
*Assistant Examiner*—Daniel Nolan
*Attorney, Agent, or Firm*—Gifford, VanOphem, Sheridan, Sprinkle & Nabozny

[57] ABSTRACT

A burial vault includes a lid and a box portion. Depending rests are attached to the exterior bottom face of the box portion, so as to permit easy transportation of the vault. In another preferred embodiment the vault lid has recesses on its exterior face, which correspond to and are engageable with these rests. In still another preferred embodiment, these rests are self-burying in the ground in order to firmly seat the vault during use.

5 Claims, 7 Drawing Figures

BURIAL VAULT STRUCTURE

BACKGROUND OF THE INVENTION

I. Field of the Invention

The present invention is directed to burial vaults, and more particularly, to burial vaults which are easily transportable, or stackable, or both.

II. Description of the Prior Art

Burial vaults have long been known, and are used to contain caskets when they are buried in the ground. Typically, a burial vault is a boxlike structure having a flat bottom and a removable lid, and a wall portion disposed therebetween. The burial vault is generally designed to prevent the entry of vermin or debris into the vault when the lid is placed on it. Burial vaults are usually constructed from rigid, wear-resistant materials, such as concrete or a concrete-filled resinous plastic shell. Examples of the latter type of burial vault can be found in our U.S. Pat. Nos. 4,060,581 (Nov. 29, 1977), 4,261,083 (Apr. 14, 1981) and 4,314,390 (Feb. 9, 1982).

One problem associated with prior burial vaults has been the difficulty of transporting them. The not insignificant weight of burial vaults, in combination with the flat bottom, makes the moving and lifting of the vaults awkward tasks at best. The awkwardness is increased if a casket is present in the vault to be moved, as the overall weight will be greater.

The construction of conventional burial vaults is a source of part of the expense of transporting them. If the vault lid has a curved exterior surface, the flat bottom on the box portion prevents the stacking of one vault on top of another during transportation. If, on the other hand, the lid has a flat surface, the vault can be stacked for transportation. However, the flat bottom will again make lifting and unstacking difficult, due to a lack of clearance space between the abutting lid of one vault and bottom of another vault.

SUMMARY OF THE PRESENT INVENTION

The present invention overcomes these and other problems by providing a burial vault which is easily transportable, or stackable, or both. In the type of burial vault comprising a lid and a box portion, the invention comprises the improvement of providing at least one rest on the exterior bottom face of the box portion. Preferably, the rest or rests depend outwardly from the plane of the remainder of the exterior bottom face. Also, the exterior lid face preferably bears recesses therein, corresponding to the rest or rests provided on the bottom on the vault. The box portion can thus abuttingly rest on the lid of another vault, so that the vaults are stackable.

Also preferably, the rests are dimensioned relative to the exterior lid face so as to permit the free passage of lifting means beneath the box portion, when it either rests on a flat surface or abuts a vault lid.

In another preferred embodiment of the invention, each of the at least one rests is engageable with the ground, for example, by self-burying.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF THE PREFERRED EMBODIMENTS OF THE PRESENT INVENTION

Figure 1:
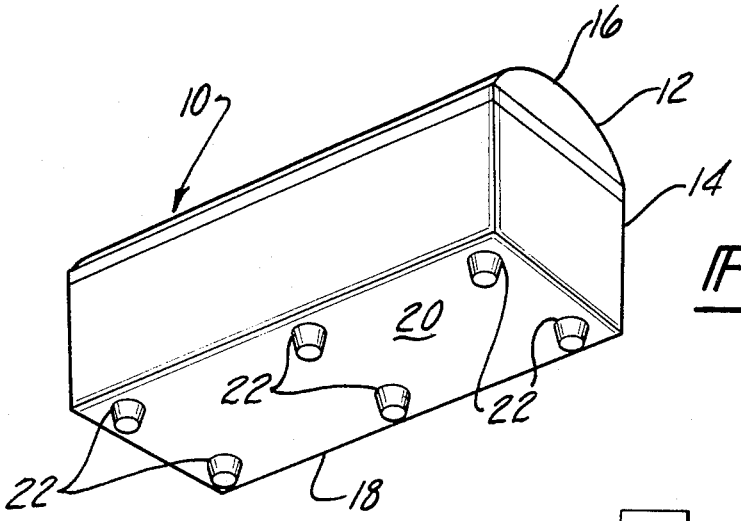
FIG. 1 is a perspective bottom view of a first preferred embodiment of the present invention.
Figure 3:
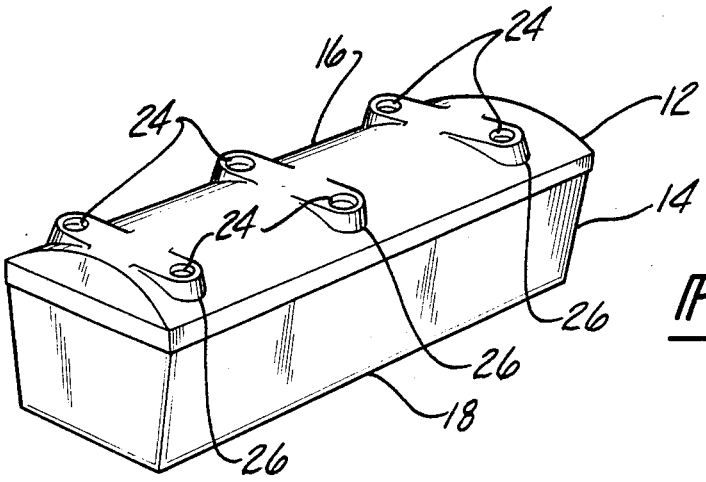
FIG. 3 is a perspective top view of a first preferred embodiment of the present invention.
Figure 4:
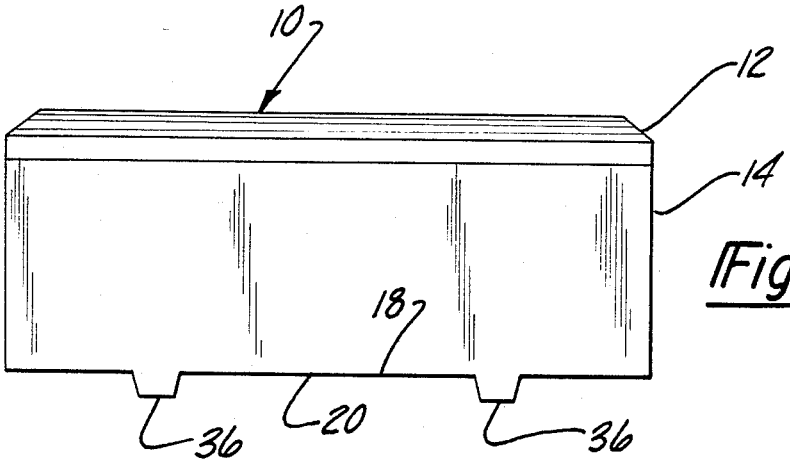
FIG. 4 is a side view of another preferred embodiment of the present invention.

With reference now to FIGS. 1 and 3, a first preferred embodiment of the present invention is thereshown and comprises a burial vault 10 having a lid 12 and a box portion 14. Preferably, the lid 12 is removable from the box portion 14, although in another preferred embodiment (not shown) the lid 12 can be hingedly fixed to the box portion 14. The lid 12 has an exterior face 16, and the box portion 14 has an exterior bottom face 18.

The exterior bottom face 18 defines a base plane 20. At least one and preferably six rests 22 are disposed on the exterior bottom face 18, and extend outwardly from the base plane 20. The rests 22 are frustoconical in shape, and preferably are formed integrally with the box portion 14. The vault 10 is constructed of an appropriately rigid or resistant material or composite.

A matching number of corresponding recesses 24 are formed in the exterior face 16 of the lid 12. Each of these recesses 24 can be disposed in a relatively wide raised bead 26, as shown, or can be formed directly in the exterior face 16 of the lid 12. Each of the recesses 24 is adapted to be engageable with at least a portion of the corresponding rest 22. In particular, each of the recesses 24 has a frustoconical shape similar to that of each of the rests 22, so that each of the rests 22 is partly insertable into and abuttingly engages the corresponding recess 24.

Figure 2:
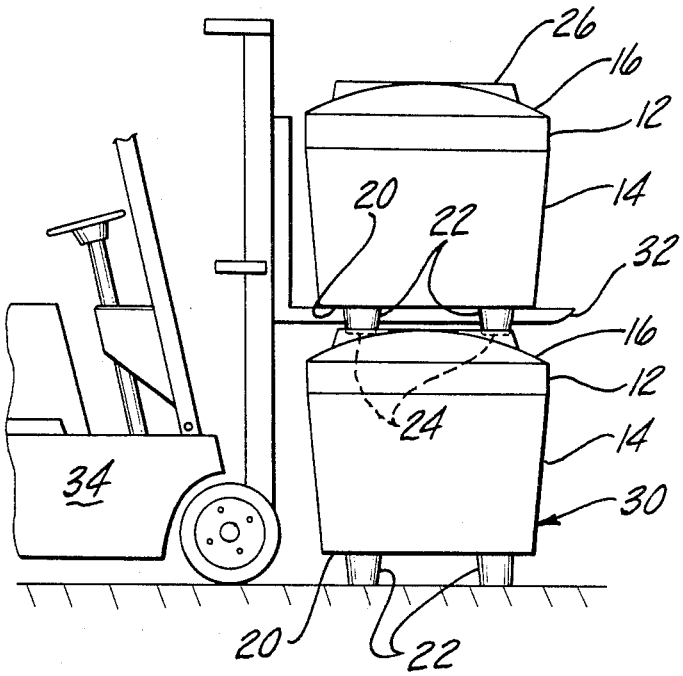
FIG. 2 is an end view of a first preferred embodiment of the present invention.

As is best shown in FIG. 2, during use of the burial vault 10 of the present invention, the provision of the rests 22 on the exterior bottom face 14 of the box portion 14 permits two or more burial vaults 10 to be stacked atop one another in an interlocked and engaged fashion. The rests 22 on an upper vault 28 are engaged with the corresponding recesses 24 on a lower vault 30 to provide this stacking. Preferably, each of the rests 22 extend sufficiently outwardly from the base plane 20 so as to facilitate the lifting and transport of the vault. By way of example, the rests 22 on each of the upper and lower vaults 28 and 30 are dimensioned so as to permit the introduction of lifting means, such as a fork 32 of a forklift 34, between the box portion 14 and the surface or object upon which the vaults 28 and 30 lie.

The rests 22 thus also serve to space the box portion 14 somewhat away from the surface or object upon which the vault 10 lies.

Figure 5:
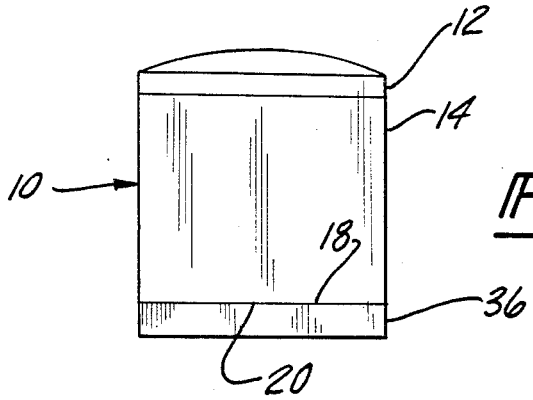
FIG. 5 is an end view of another preferred embodiment of the present invention.

Rests of different shapes or numbers can perform this function of providing space beneath, and exterior to, the box portion 14. In FIGS. 4 through 7 are shown other preferred embodiments of the present invention, wherein only a single pair of rests 36 are disposed on the exterior bottom face 18 of the box portion 14. Each of the rests 36 extends transversely across the exterior bottom face 18 (FIG. 5).

Although not shown, a pair of correspondingly shaped recesses can be disposed in the exterior face 16 of the lid 12 of the vaults of FIGS. 4–7. The rests 36 can also be dimensioned, as previously described, in order to yield an access space for an appropriate lifting means.

Figure 6:
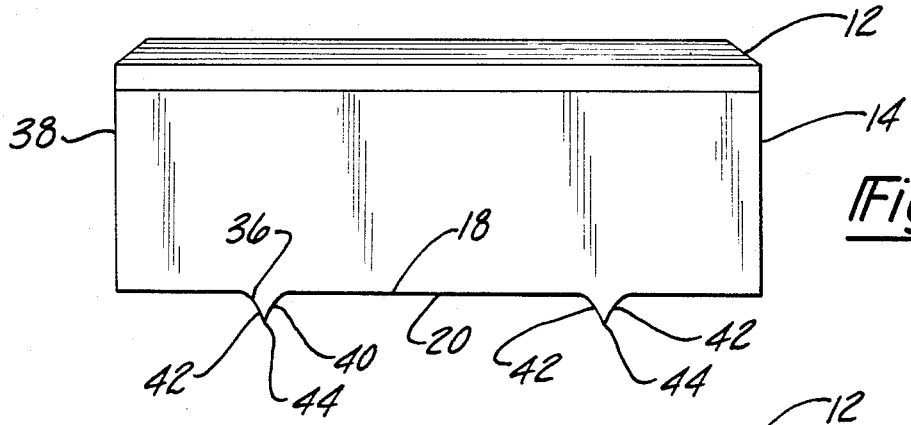
FIG. 6 is a side view of another preferred embodiment of the present invention.

With particular reference to FIG. 6, a preferred embodiment of the present invention is thereshown wherein each of the rests 36 of a vault 38 comprises a rest 40 which has curved, ramped sides 42, which meet at a straight ridge 44. Preferably, this ridge 44 is sharp enough to breach or pierce the surface of the ground upon which the vault 38 is placed, so that the ridge 44 (and thus each of the rests 40) engages the ground. In particular, each of the rests 40 are thus self-burying in the ground. Each of the rests 40 are also preferably rigid, however, so that the spacing function is not lost when the vault 38 is stacked or placed on a hard surface. The advantage of such a self-burying rest is that the vault will not slide if it is stacked or placed upon a hard surface, and is resistant to sliding when placed upon uneven ground.

Figure 7:
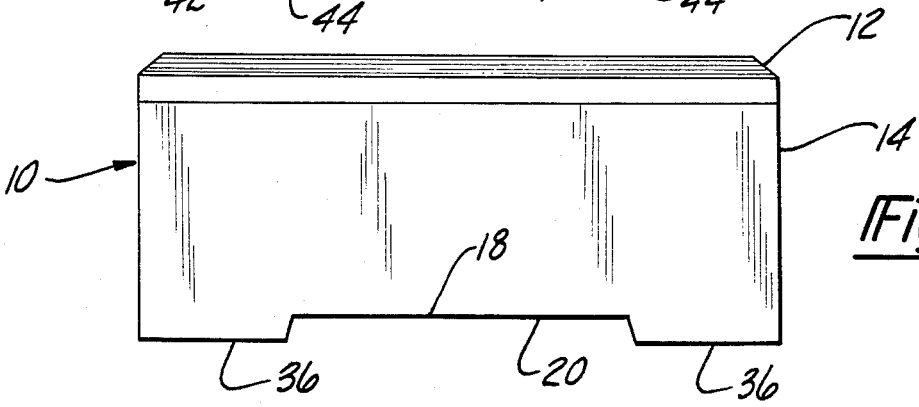
FIG. 7 is a side view of another preferred embodiment of the present invention.

Having described my invention, however, many modifications thereto will become apparent to those skilled in the art to which it pertains without deviation from the spirit of the invention as defined by the scope of the appended claims. In particular, the rests 22 or 36 provided on the bottom of the vault 10 may extend over a substantial portion of the bottom of the vault 10, greater than as shown in FIG. 7. In such a case, it could appear to a careless observer that a depending rest has been disposed on the exterior lid surface, and that a recess has been disposed in the bottom of the vault. The rests 22 or 36 would still separate the box portion 14 from the surface upon which the vault lies and would still be disposed on the bottom 18 of the vault 10. In such a case, the recesses would extend across a matchingly substantial portion of the exterior face of the lid.

We claim:

1. A burial vault comprising:

an elongated box portion having a top, a bottom, two elongated sides and two ends, an elongated lid having a top and a bottom, said lid being dimensioned so that its bottom covers the top of said box portion, a plurality of spaced rests attached to the bottom of the box portion so that said rests protrude downwardly from the bottom of the box portion, said plurality of rests comprising at least two longitudinally spaced rests adjacent each side of the box portion, and a plurality of recesses formed on the top of the lid, said recesses registering with and adapted to abuttingly receive said rests, wherein said rests and said recesses are dimensioned so that, with the rests on one box portion positioned within and supported by the recesses on one lid, the bottom of said one box portion is spaced upwardly from the top of said one lid thereby forming a space between said top of the lid and said bottom of said box portion, said space being open to said sides and being adapted to allow the engagement of lifting means with said bottom of said one box portion; and wherein said rests comprise the sole means for supporting said one box portion on said one lid.

2. The invention according to claim 1, wherein said lid comprises at least two longitudinally spaced raised beads on its top, said recesses being formed in said beads.

3. The invention according to claim 1, wherein each rest is frustoconically shaped.

4. The invention according to claim 1, wherein said valut lid is removable from said box portion.

5. The invention as defined in claim 1, wherein the rests adjacent one side of the box portion are laterally aligned with the rests adjacent the other side of the box portion.

* * * * *